United States Patent [19]

Mena et al.

[11] 4,417,920

[45] Nov. 29, 1983

[54] PROCESS FOR ELIMINATING METALLIC IMPURITIES FROM MAGNESIUM BY INJECTING A HALOGENATED DERIVATIVE OR BORON

[75] Inventors: Andre Mena, St. Jean-de-Maurienne; Jean-Michel Charriere, Creil; Jean Desbrest, Barbazan, all of France

[73] Assignee: Societe Francaise d'Electrometallurgie Sofrem, Paris, France

[21] Appl. No.: 438,651

[22] Filed: Nov. 2, 1982

[30] Foreign Application Priority Data

Nov. 25, 1981 [FR] France ..... 81 22451

[51] Int. Cl.[3] ..... C22B 26/22

[52] U.S. Cl. ..... 75/63; 75/67 A

[58] Field of Search ..... 75/63, 67 R, 67 A, 93 AB

[56] References Cited

U.S. PATENT DOCUMENTS 3,843,355 10/1974 Reding ..... 75/67

FOREIGN PATENT DOCUMENTS 115370 7/1942 Australia ..... 75/67 A

*Primary Examiner*—M. J. Andrews

*Attorney, Agent, or Firm*—Oblon, Fisher, Spivak, McClelland & Maier

[57] ABSTRACT

The invention concerns a process for eliminating metallic impurities from magnesium, in particular iron, silicon and manganese.

For that purpose, a halogenated derivative of boron such as $BCl_3$ is injected into the molten magnesium, in a proportion of from 0.05 to 5 kg of pure boron per tonne of magnesium. The magnesium may first be subjected to a refining operation using $TiCl_4$ or a mixture comprising $TiCl_4+FeCl_3$.

The magnesium produced contains less than 1 ppm of residual boron, less than 20 ppm of Fe and Si and less than 30 ppm of Mn.

6 Claims, No Drawings

PROCESS FOR ELIMINATING METALLIC IMPURITIES FROM MAGNESIUM BY INJECTING A HALOGENATED DERIVATIVE OR BORON

The present invention concerns a process for eliminating metallic impurities contained in magnesium, by injecting a halogenated derivative of boron.

Magnesium which is produced by a metallothermal reaction and in particular by the method of silicothermal reduction of dolomite or magnesia under reduced pressure in a molten slag at a temperature of about 1600° C., based on CaO, $SiO_2$, $Al_2O_3$ and MgO (Magnetherm process, French patent No 1 194 556=U.S. No. Pat. 2,971,833 in the name of SOFREM), may contain proportions of metallic elements such as silicon, iron or manganese, that in some cases are considered to be too high in relation to various specifications, depending on the use thereof, in particular in regard to the aspects referred to as high-purity qualities.

In order to purify "Magnetherm" magnesium, use has been made of the sublimation method which is generally suitable for the so-called high-purity qualities, but the sublimation operation is a slow and expensive one and suffers from the disadvantage of consuming a substantial amount of electrical energy.

As regards to refining by segregation, as disclosed in French patent No 1 594 154 (=U.S. Pat. No. 3,671,229) in the name of ALUMINIUM PECHINEY, that process is not suitable for the metallic impurities which are referred to as "peritectic" impurities, such as manganese.

It is known for some of the impurities in magnesium, and more particularly manganese, iron and silicon, to be removed by injecting titanium tetrachloride $TiCl_4$. That process is described in U.S. Pat. No. 2,779,672 to DOW CHEMICAL CO. However, the amount of impurities removed by carrying out that process is still highly unsatisfactory, with the residual manganese content being of the order of 200 to 500 ppm.

The present invention concerns a process for eliminating metallic impurities from liquid magnesium, which can be carried out either as an operation that is complementary to a preliminary treatment using any refining agent such as $TiCl_4$ or halogenated fluxes, or as a single refining treatment, and which produces a level of purity that is compatible with the requirements of all the known uses of high-purity magnesium.

The above-indicated process comprises injecting into the liquid magnesium, by a suitable means, a halogenated derivative of boron such as the trichloride $BCl_3$, the trifluoride $BF_3$ or alkali metal, alkaline-earth or magnesium fluoborates.

Surprisingly, it was found that the refining process using a boron derivative left only a residual amount of boron in the magnesium, of the order of 1 ppm or even less, which does not give rise to any disadvantage, irrespective of the uses to which the metal which is thus purified is put.

Among the boron derivatives which can be used for carrying the invention into effect, the trichloride is particularly suitable by virtue of its boiling point which is +12.5° C., which permits it to be stored in a liquid condition and under a moderate pressure in a steel cylinder. In order to ensure that the $BCl_3$ is regularly fed into and properly distributed in the mass of liquid magnesium to be refined, it is preferable for it to be entrained in a flow of dry inert gas such as argon. The amount of halogenated derivative injected into the Mg corresponds to an amount of pure boron which is between 0.05 and 5 kg and preferably 0.1 and 1 kg per tonne of crude magnesium. When using $BCl_3$ for example which contains 9.2% of pure B, that corresponds to an amount of 0.54 to 54 kg and preferably from 1.09 to 10.9 kg of $BCl_3$ per tonne of magnesium.

Finely powdered potassium fluoborate can also be entrained by means of an inert gas flow, using any known process.

The actual operation of injecting the halogenated derivative into the mass of liquid magnesium may be effected by one of the procedures which are well known to the man skilled in the art, in particular by means of a pipe of suitable material, which dips to the bottom of the ladle containing the liquid magnesium, or a pipe which passes through the wall of the ladle adjacent to the bottom thereof, or by means of any other equivalent process.

The reaction of the halogenated boron derivative with the magnesium probably results in the formation of "nascent" boron which reacts with the elements such as Fe, Mn, Si, giving stable borides, with a specific gravity which is much higher than that of the liquid magnesium at a temperature of 700° to 750° C., which rapidly settle. The settling operation may be facilitated by the addition of halogenated fluxes which are usually employed in casting magnesium.

EMBODIMENTS

In the various examples, the liquid magnesium was disposed in a steel ladle and raised to a temperature of from 700° C. to 750° C.

The cylinder containing the $BCl_3$ was suspended from a high-precision weighing means and provided with a heating means for raising it to a temperature of from 20° to 60° C. The flow rate was controlled by a control valve actuated in dependence on the variation in the weight of the cylinder.

EXAMPLE 1

7140 kg of magnesium, which had been previously refined using $TiCl_4$, was treated by injecting 35 kg of $BCl_3$, which was entrained by a flow of dry argon, at a rate of 20 kg per hour, by means of a steel lance, at a temperature of 730° C. The results obtained were as follows:

| Impurities in ppm | Fe | Si | Mn |
|---|---|---|---|
| Before injection of $BCl_3$ | 28 | 18 | 530 |
| After injection of $BCl_3$ | <20 | 10 | <30 |

EXAMPLE 2

In the same manner, and at the same rate, 9405 kg of magnesium which had been previously refined using $TiCl_4$ was treated by injecting 33 kg of $BCl_3$, in argon. The results obtained were as follows:

| Impurities in ppm | Fe | Si | Mn |
|---|---|---|---|
| Before injection | 30 | <20 | 450 |
| After injection | <20 | <20 | <30 |

EXAMPLE 3

2700 kg of crude thermal magnesium was directly treated by means of 21.5 kg of $BCl_3$, at a temperature of 750° C., at a rate corresponding to 12 kg/h of $BCl_3$. The results obtained were as follows:

| Impurities in ppm | Fe | Mn |
|---|---|---|
| Before injection | 80 | 970 |
| After injection | <10 | <50 |

The preliminary refining operation using $TiCl_4$, as described in above-mentioned U.S. Pat. No. 2,779,672, is found to be effective in reducing the proportion of silicon, but highly unsatisfactory as regards magnesium and iron.

The applicants found that, in the preliminary refining operation, the $TiCl_4$ could be totally or partially replaced by ferric chloride $FeCl_3$, which is sublimated and entrained by a flow of dry argon. Mixtures formed by from 10 to 100% of $FeCl_3$ and from 0 to 90% of $TiCl_4$ are satisfactory and permit the proportion of silicon to be reduced for example from 1500/1000 ppm to about 100 ppm.

Moreover, it was found that certain metallic impurities which are not generally encountered in magnesium but which may accidentally occur therein such as chromium and nickel are also removed by the treatment employing $BCl_3$, down to a proportion of from 10 to 30 ppm.

Operations of quantitatively determining the amounts of boron, which were carried out on the magnesium after treatment with the $BCl_3$, were performed by spectrophotocolorimetry of the complex formed with methylene blue.

The residual boron content is from 0.5 to 1.5 ppm, which in particular permits that metal to be used for the production of high-purity titanium or zirconium using the Kroll process for reducing $TiCl_4$ or $ZrCl_4$ by means of magnesium.

We claim:

1. A process for the purification of a magnesium melt having iron, silicon and/or manganese impurities therein, comprising:

injecting a halogenated boron derivative selected from the group consisting of $BCl_3$, $BF_3$, and their combination into or near the bottom of said melt, and recovering magnesium from the melt purified thereby.

2. The process of claim 1, wherein said halogenated boron derivative is $BCl_3$.

3. The process of claim 1 or 2, wherein said halogenated boron derivative is injected into said magnesium melt in a flow of inert gas.

4. The process of claim 1, wherein said injected halogenated boron derivative is injected in an amount of from 0.05–5 kg boron per ton of magnesium.

5. The process of claim 4, wherein said halogenated boron derivative is injected in an amount of from 0.1–1 kg boron per ton of magnesium.

6. The process of claim 1, wherein, prior to said injection of the halogenated boron derivative, a purifying compound selected from the group consisting of iron trichloride, titanium tetrachloride and their combination wherein titanium tetrachloride is present in amounts of up to 90% by weight, is injected into said magnesium melt.

* * * * *

UNITED STATES PATENT AND TRADEMARK OFFICE

CERTIFICATE OF CORRECTION

PATENT NO. : 4,417,920

DATED : November 29, 1983

INVENTOR(S) : Mena et al

It is certified that error appears in the above-identified patent and that said Letters Patent is hereby corrected as shown below:

Title incorrect, should read as follows:

--[54] PROCESS FOR ELIMINATING METALLIC IMPURITIES FROM MAGNESIUM BY INJECTING A HALOGENATED DERIVATIVE OF BORON--

Signed and Sealed this

*Thirteenth* Day of *March 1984*

[SEAL]

*Attest:*

GERALD J. MOSSINGHOFF

*Attesting Officer*

*Commissioner of Patents and Trademarks*